US006853882B2

(12) United States Patent
Dudley

(10) Patent No.: US 6,853,882 B2
(45) Date of Patent: Feb. 8, 2005

(54) HVAC SYSTEM MONITORING

(75) Inventor: Kevin F. Dudley, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 440 days.

(21) Appl. No.: 10/147,402

(22) Filed: May 17, 2002

(65) Prior Publication Data

US 2003/0216839 A1 Nov. 20, 2003

(51) Int. Cl.[7] ..... G05B 13/00
(52) U.S. Cl. ..... 700/276; 700/278
(58) Field of Search ..... 700/9, 276, 277, 700/278, 282, 299, 300; 702/99, 105, 130; 162/200–303; 236/1, 44

(56) References Cited

U.S. PATENT DOCUMENTS

| | | | | |
|---|---|---|---|---|
| 5,696,695 | A * | 12/1997 | Ehlers et al. | 700/286 |
| 5,801,940 | A * | 9/1998 | Russ et al. | 700/9 |
| 6,079,626 | A * | 6/2000 | Hartman | 236/13 |
| 6,216,956 | B1 * | 4/2001 | Ehlers et al. | 236/47 |
| 2001/0010032 | A1 * | 7/2001 | Ehlers et al. | 702/62 |

* cited by examiner

*Primary Examiner*—Leo Picard
*Assistant Examiner*—Chad Rapp

(57) ABSTRACT

A computer is operative to analyze comfort level information from one or more locations to be provided with conditioned air. The computer determines whether the comfort level information indicates that a particular overall level of comfort is being repetitively requested by a location over an extended period of time. The computer is operative to send a warning signal when this occurs.

18 Claims, 6 Drawing Sheets

HVAC SYSTEM MONITORING

BACKGROUND OF THE INVENTION

This invention relates to monitoring the provision of conditioned air to one or more locations using information gathered from the locations.

The provision of conditioned air to one or more locations has heretofore depended on gathering information such as sensed temperature and preferred temperature settings from these locations. This information is typically provided by thermostats in the locations. This information is used to define demands on one or more HVAC systems providing conditioned air to the locations.

The HVAC system may from time to time experience a particularly heavy demand being placed upon it for heating or cooling a given location. It would be preferable to have logic associated with the control of the HVAC system that would examine any excessively heavy demand for heating or cooling to determine whether any action should be taken to alleviate or otherwise address the demand for the particular location.

The above may be particularly true in a system that does not include a typical thermostat having a sensed temperature that can be read to determine whether any progress is being made as to raising or lowering the overall temperature in the location. This would be true of the comfort control system set forth in commonly assigned U.S. patent application Ser. No. 10/053,954, filed on Dec. 20, 2001. This system allows occupants in a given location to express their feeling as to level of comfort by entering levels of comfort into data entry devices. The system does not directly measure the progress made by one or more HVAC systems in meeting the overall demand other than to note whether the occupants continue to enter levels of comfort not being met by the conditioned air being provided to the location. It would be preferable if there were a means within such a system to at least check to see whether there were any problem with the flow of conditioned air to the particular location.

SUMMARY OF THE INVENTION

Comfort level information from various locations that are to be provided with conditioned air is gathered and analyzed by a computer. The computer preferably computes levels of comfort for each location based upon the received information. Computed levels of comfort for at least one location are checked to determine whether these preferred levels of comfort have been repeatedly computed in the past for the particular location. In the event that they have, the network computer will at some point determine that something could be wrong with the provision of air to the location.

In a preferred embodiment, individual occupants in one or more locations select respective levels of comfort through data entry devices in these locations. Each data entry device is programmed to display a menu of comfort level options that may be selected by the user of the computer. Each data entry device is operative to store any selected comfort level and timely provide the stored results to the computer and to thereafter erase the stored results.

The disclosed exemplary embodiment deals with processing levels of comfort related to temperature in a location. The invention is, however, equally applicable to other measurements of comfort that may be analyzed and thereafter acted upon, including for instance, humidity or air flow.

BRIEF DESCRIPTION OF THE DRAWINGS

Further advantages of the present invention will be apparent from the following detailed description in conjunction with the accompanying drawings, wherein.

DESCRIPTION OF THE PREFERRED EMBODIMENT

Figure 1:
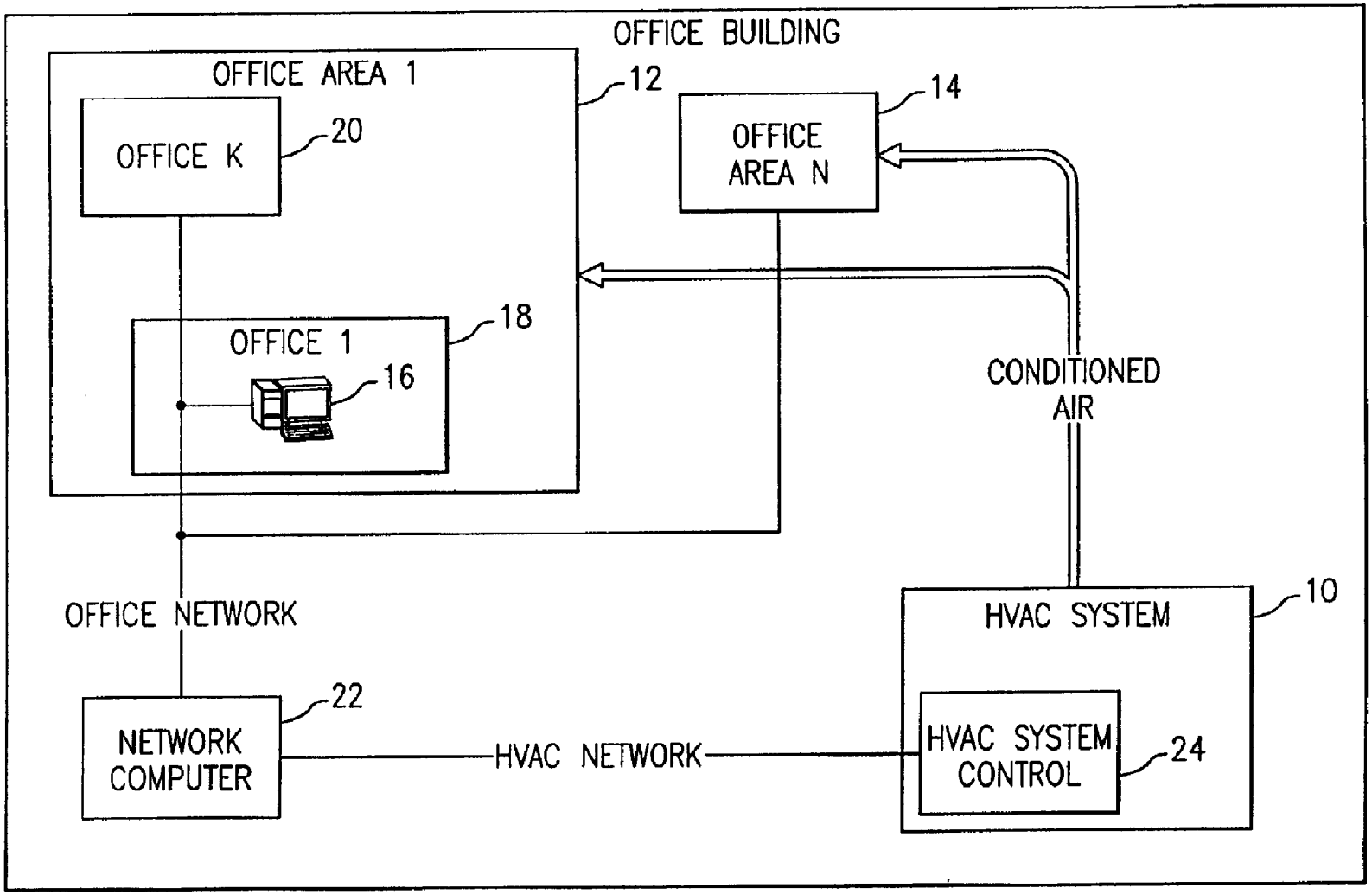
FIG. 1 illustrates an office building with a number of offices grouped into a number of office area locations.

Referring to FIG. 1, an HVAC system 10 provides conditioned air to a number of individual office area locations such as office area location 12 and office area location 14. Each office area location will carry a particular office area index value for purposes of identifying comfort level data originating from the particular office area location. This is indicated by office area location 12 being office area 1 whereas office area location 14 is identified as office area N.

Each office area location is seen to include a number of individual personal computers such as computer 16 located in an office 18. Each office within office area location 12 is identified by an office index "K" where K=for instance 1 for office 18 and is for instance another value for office 20.

Each computer within an office in a particular office area location is preferably connected to a network computer 22. As will be explained in detail hereinafter, the network computer 22 is operative to collect comfort level information entered in each of the computers within the individual offices of each office area location. The collected information is analyzed by particular office area index value. The network computer is thereafter operative to generate overall indications as to level of comfort in each office area. These overall indications as to comfort level are preferably indexed in accordance with the office area index and provided to an HVAC system control 24. The HVAC system control 24 is operative to control the HVAC system 10 so as to provide appropriate amounts of conditioned air to each of the office areas in accordance with the information received from the network computer 22.

Figure 2:
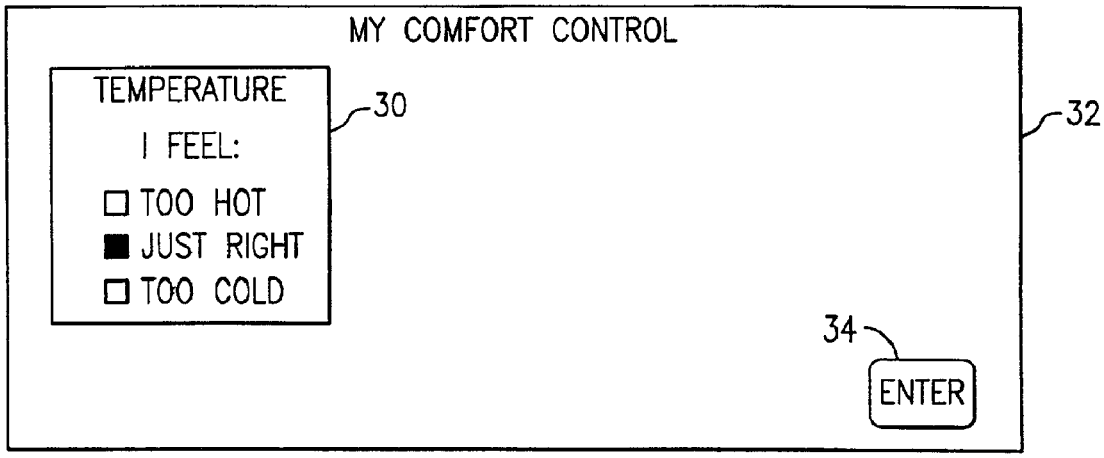
FIG. 2 illustrates a display menu as to comfort levels appearing on the screens of computers in the offices of FIG. 1.

Referring now to FIG. 2, a comfort level menu 30 appearing on the screen 32 of an office computer such as office computer 16 is shown. The comfort menu 30 preferably includes three levels of comfort for the temperature in the office in which the computer is located. These comfort levels are expressed as "TOO HOT", "JUST RIGHT", or "TOO COLD". The office computer preferably includes a point and click operating system which allows the user to click on the particular comfort level being experienced by the occupant of the office. The occupant of the office thereafter preferably clicks on an icon 34 labeled "ENTER" after making his or her selection as to comfort level from the menu 30.

Figure 3:
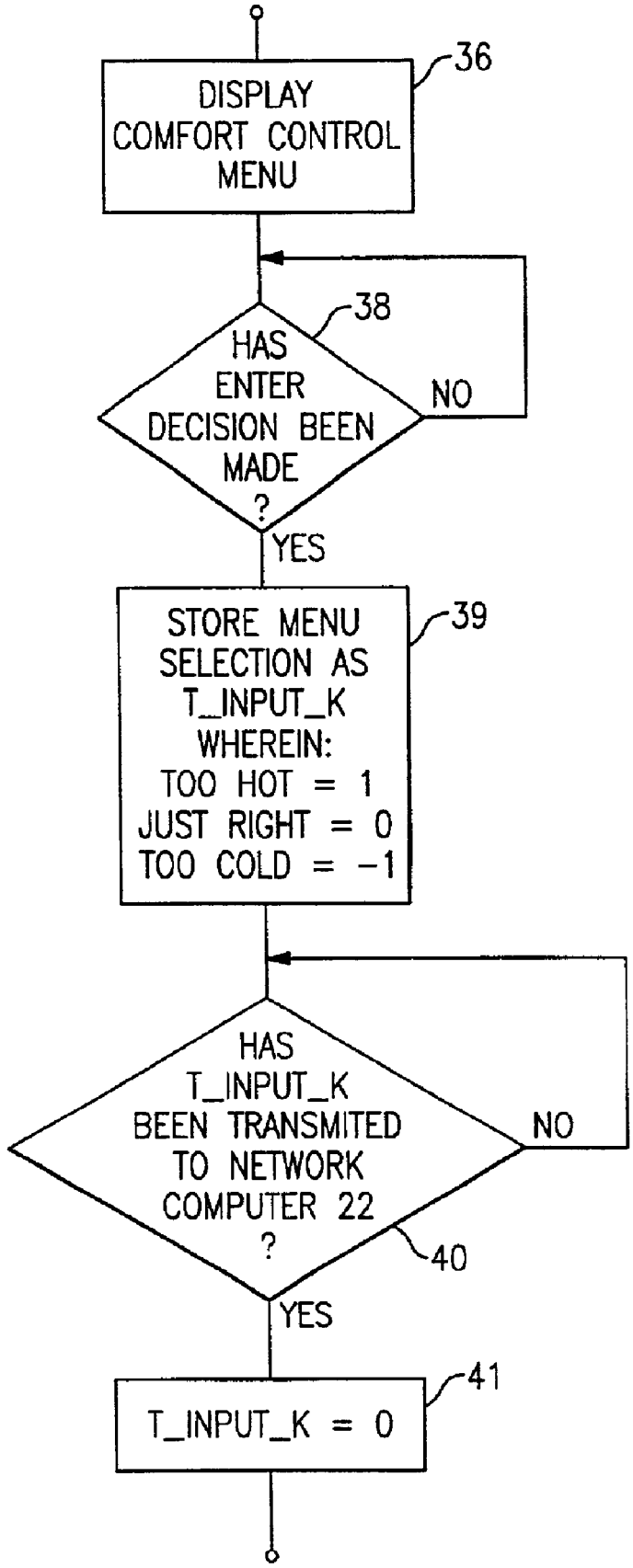
FIG. 3 illustrates a program located in the computers which generate the display menu of FIG. 2.

Referring now to FIG. 3, the software routine executed by a processor within an office computer is shown. The routine begins with a step 36 wherein a comfort control menu is displayed on the computer screen of the office computer. The comfort control menu could be the particular comfort control menu 30 of FIG. 2. The processor proceeds to a step 38 and inquires as to whether an "ENTER" decision has been made. An "ENTER" decision will have been made when the occupant clicks upon the "ENTER" icon 34 appearing on the computer screen 32 in FIG. 2. When an "ENTER" decision has been made, the processor proceeds from step 38 to a step 39 and stores the menu selection made from the displayed menu of step 36. For a menu selection made from the menu 30, the processor preferably stores the selection as "T_INPUT_K". The value of "K" within the stored menu selection variable "T_INPUT_K" will be the office index value for the particular office in which the office computer is located. The stored menu selection in "T_INPUT_K" is preferably 1 for a comfort level selection of "TOO HOT", 0 for a comfort level selection of "JUST RIGHT", and −1 for a comfort selection of "TOO COLD".

Referring now to step 40, inquiry is made as to whether the stored selection of T_INPUT_K has been sent to the network computer 22. As will be explained in detail hereinafter, the network computer preferably initiates a request for this information at some point in time. When this occurs, the value of T_INPUT_K is set equal to zero in a step 41 so as to not continually transmit the previously stored menu selection.

Figures 4, 4A:
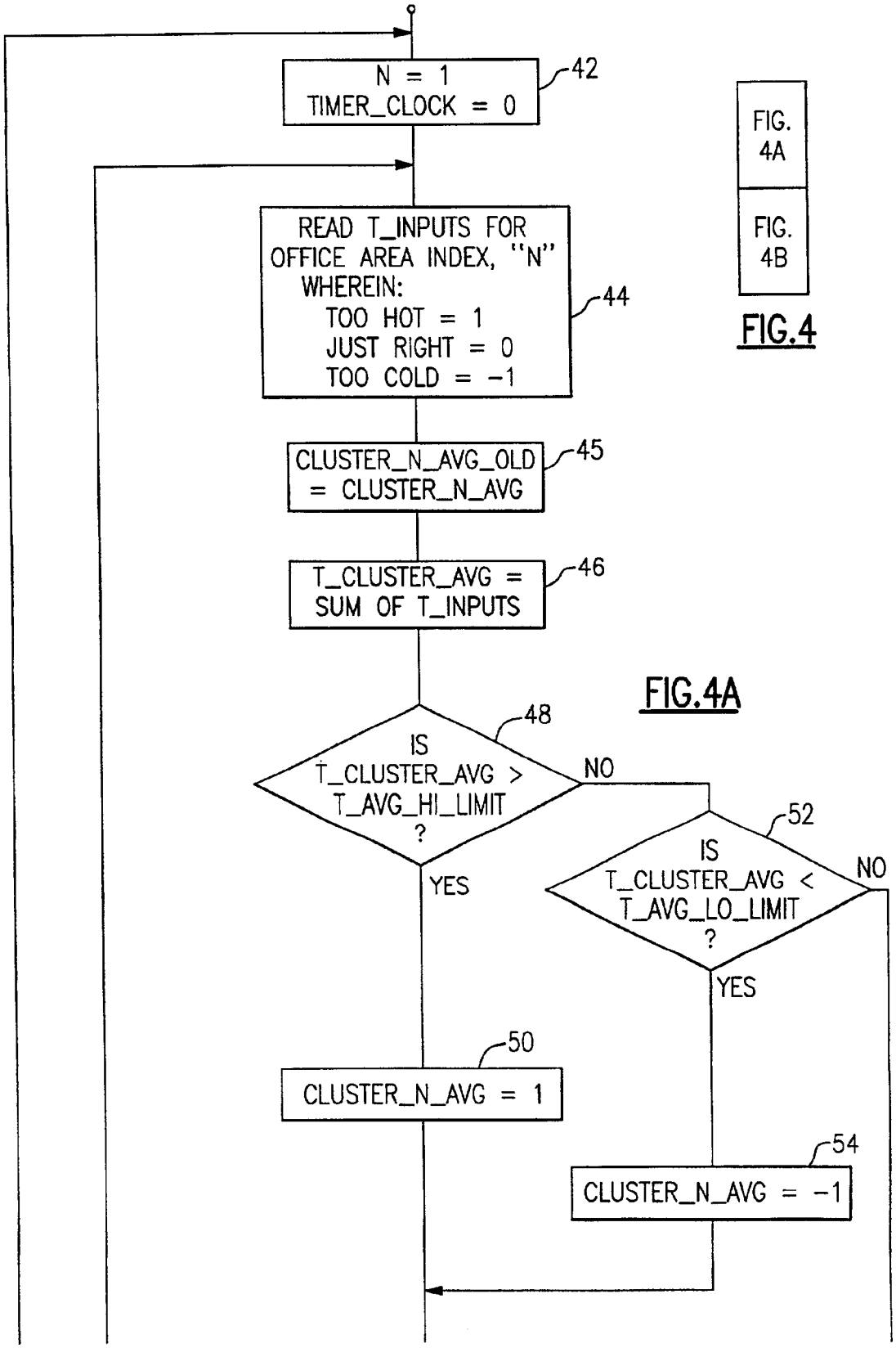
FIG. 4 illustrates a program located on a network computer which collects and analyzes the menu selections entered into the programmed computers in the offices of FIG. 1.
Figure 4B:
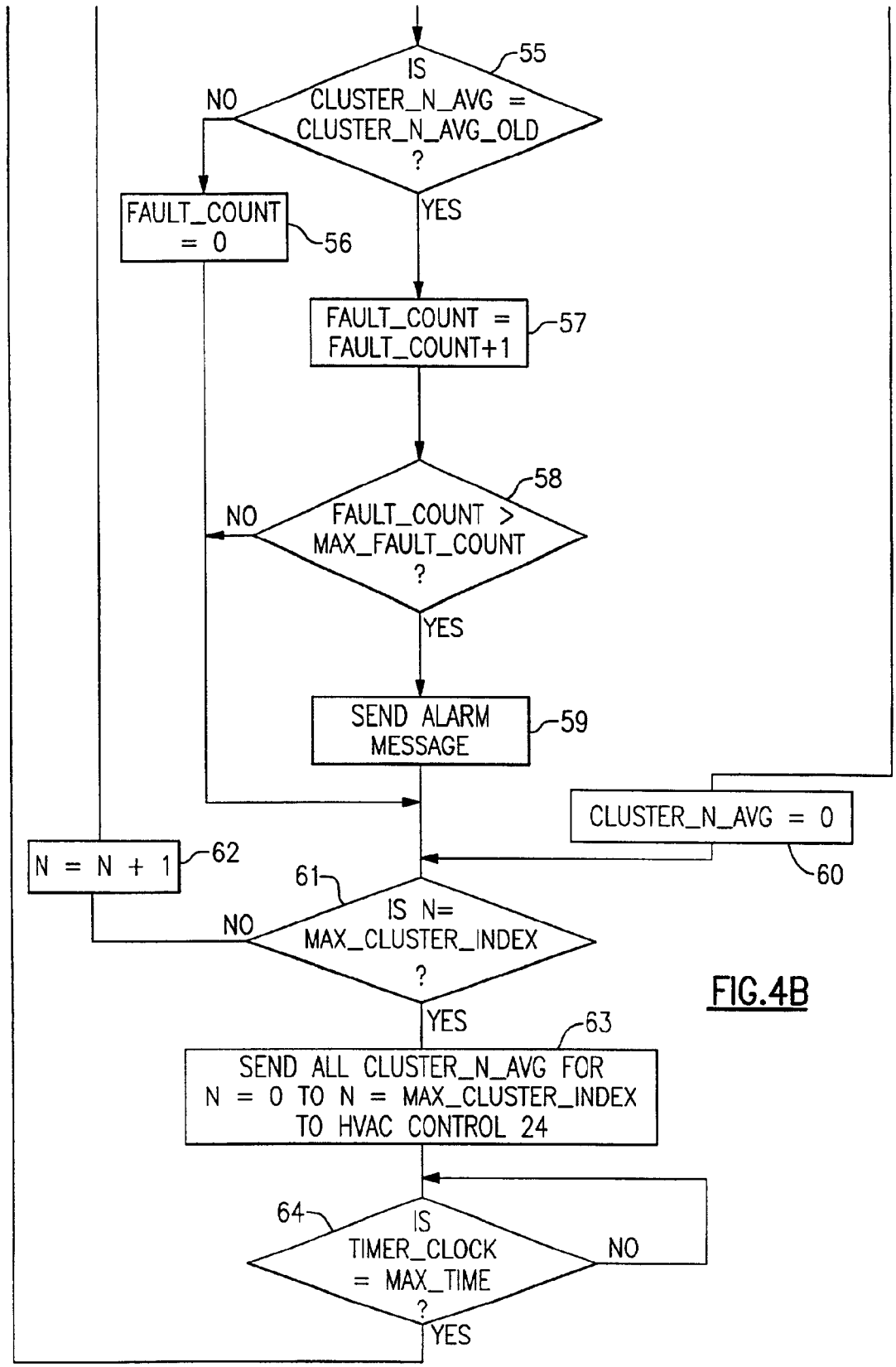

Referring now to FIG. 4, the computer program implemented by the processor within the network computer 22 is shown. The program begins with a step 42 wherein the office area index, "N" is set equal to 1. A "TIMER_CLOCK" is also set equal to 0 so as to thereafter begin clocking time from a system clock associated with the processor in the network computer. The processor proceeds to step 44 and reads "T_INPUTS" for the office area index, "N". Since "N" will be initially set equal to 1, the processor will be reading the menu selections for the office computers in office area 12. The processor will preferably read each stored menu selection, "T_INPUT_K" for the particular office computer in the office area 12. It will be remembered that the value of the stored menu selection will be 1 if the comfort level selection was "TOO HOT", 0 if the comfort level selection was "JUST RIGHT", and −1 if the comfort level selection was "TOO COLD". The processor will proceed to a step 45 and set the value of "CLUSTER_N_AVG_OLD" equal to the present value of "CLUSTER_N_AVG". As will be explained hereinafter, this allows the processor to track any newly computed value of "CLUSTER_N_AVG" with the previously computed value of this variable. The processor will proceed from step 45 to a step 46 and compute the value of a variable "T_CLUSTER_AVG". The value of this variable is equal to the sum of the read "T_INPUTS" in step 44. The processor will proceed to a step 48 and inquire as to whether the value of "T_CLUSTER_AVG" is greater than the value of a variable "T_AVG_HI_LIMIT". It is to be understood that the value of "T_AVG_HI_LIMIT" will be predefined for the particular office building or even office area under review. In this regard, assuming that there are ten office computers in each office area of the office building, then the value of "T_AVG_HI_LIMIT" could be equal to 5. This would require that the net sum of T_INPUTs would have to be greater than 5 in step 48 in order for the processor to proceed to a step 50. It is, of course, to be appreciated that the value of "T_AVG_HI_LIMIT" could be set lower so as to not require that so many stored menu selections be equal to 1. Referring to step 50, in the event that "T_CLUSTER_AVG" is greater than "T_AVG_HI_LIMIT", then the processor sets the variable "CLUSTER_N_AVG" equal to 1. The value of "N" in this variable will equal the current office area index value. This variable will therefore be an overall indication as to the comfort level in the office area indicated by the index value "N". This overall indication would be "TOO HOT" out of step 50.

Referring again to step 48, in the event that "T_CLUSTER_AVG" is not greater than "T_AVG_HI_LIMIT", then the processor will proceed along a no path to a step 52. Referring to step 52, the processor will inquire as to whether "T_CLUSTER_AVG" is less than the value of "T_AVG_LOW_LIMIT". It is to be appreciated that the value of "T_AVG_LOW_LIMIT" will be set for all office areas in the office building or for the particular office area then under review. This value will again be set so as to require that the net sum of "T_INPUTS" is predominantly negative so as to indicate a predominance of "TOO COLD" having been selected from the menu 30 on each screen of an office computer within the office area indicated by the index "N". For instance, this variable may be set equal to −3, −4, or even −5 for an office area including ten separate office computers. In the event that "T_CLUSTER_AVG" is less than the value of "T_AVG_LO_LIMIT", then the processor will proceed from step 52 to a step 54 and set "CLUSTER_N_AVG" equal to −1. This will be an overall indication that the office area having an office area index equal to the current value of N is too cold.

The processor proceeds from either step 50 or step 54 to a step 55 and inquires as to whether "CLUSTER_N_AVG" equals "CLUSTER_N_AVG_OLD". It will be remembered that "CLUSTER_N_AVG_OLD" is equal to the previous value of "CLUSTER_N_AVG". This will be the previously computed value of "CLUSTER_N_AVG" unless there has not been a previous computation. In the latter case, "CLUSTER_N_AVG" will have been initially set equal to zero. Assuming for the moment that "CLUSTER_N_AVG" is not equal to "CLUSTER_N_AVG_OLD", the processor will proceed to step 56 and set "FAULT_COUNT" equal to zero. The variable "FAULT_COUNT" will essentially be set equal to zero any time the next computation of "CLUSTER_N_AVG" is not equal to the previous computation of "CLUSTER_N_AVG" that was set equal to "CLUSTER_N_AVG_OLD" in step 45.

Referring again to step 55, if "CLUSTER_N_AVG" is equal to "CLUSTER_N_AVG_OLD", then the processor will proceed to step 57 and increment the value of "FAULT_COUNT" by one. The processor next inquires in step 58 as to whether "FAULT_COUNT" is greater than "MAX_FAULT_COUNT". It is to be appreciated that "MAX_FAULT_COUNT" will be set at the number of repetitive times that "CLUSTER_N_AVG" can be successively computed without a change in the results. This will preferably be a high enough number to allow for a fairly large number of successive computations to occur. This number of successive computations should allow the HVAC system to provide appropriately conditioned air to the location identified by the index "N" over a period of time defined by the value of "MAX_FAULT_COUNT" and the amount of time between successive computations. It is to be appreciated that the actual number of successive computations that is to be stipulated in "MAX_FAULT_COUNT" will vary from system to system. It is also to be appreciated that the variable "MAX FAULT_COUNT" can also be defined for each location that is to be provided with conditioned air. In this case, each location could conceivably have a different number of successive computations of the same value of its respective "CLUSTER_N_AVG" before exceeding the "MAX_FAULT COUNT" for that location.

In any event, if the value of "MAX_FAULT_COUNT" is not exceeded, then the processor will exit along the no path from step 58. On the other hand, if "MAX_FAULT_COUNT" for the location is exceeded, then the processor will proceed to a step 59 and send a signal preferably in the form of an alarm message to a predefined device. This could be a display device or an alarm device either associated with the HVAC control or the HVAC system. The message will preferably indicate the location defined by the respective index value that is experiencing menu selections being made over and over again that result in continually computed overall levels of comfort requiring further and further amounts of conditioned air. This information can be used to run diagnostics or other checks as to whether the HVAC system or one of its component parts is operating properly. In the preferred embodiment, the processor within the network computer will continue to execute the logic of FIG. 4 after having sent the alarm message.

Referring again to step 52, in the event that "T_CLUSTER_AVG" is not less than "T_AVG_LO_LIMIT", then the processor will proceed to step 60 and set "CLUSTER_N_AVG" equal to zero, wherein the value of "N" will be the particular value of the office area index. This will be an overall indication that the temperature level is "JUST RIGHT" for the particular office area.

The processor proceeds from either step 56, step 59, or step 60 to a step 61 and inquires as to whether the office area index "N" is equal to "MAX_CLUSTER_INDEX". The value of "MAX_CLUSTER_INDEX" will be equal to the highest value of the office area index identifying the last office area to be analyzed. In the event that the value of the office area index "N" is not equal to "MAX_CLUSTER_INDEX", then the processor will proceed to a step 62 and increment the office area index "N" by one before returning to step 44. It is to be understood that the processor within the network computer will again execute steps 44–61 so as to determine the overall indication of comfort for the office area indicated by the new value of office area index "N". This will be stored in the new "CLUSTER_N_AVG". The value of "CLUSTER_N_AVG" will be checked for being equal to the "CLUSTER_N_AVG_OLD" and the value of "FAULT_COUNT" will be set to zero or incremented by one before being compared to "MAX_FAULT_COUNT". An alarm message for the location defined by the current index value of "N" will be generated if appropriate. The value of the office area index "N" in the variable "CLUSTER_N_AVG" will identify the particular office area to which the alarm or the overall comfort level indication applies. The network computer 22 will also preferably note whether more than one location has been found to have had an excessive continuing demand for conditioned air.

Referring again to step 61, it will be understood that at some point, all office areas will have been analyzed and all overall comfort level indications will have been defined in respective values of "CLUSTER_N_AVG". When this occurs, the processor will proceed to a step 63 and send all CLUSTER_N_AVGs for N=0 to N=MAX_CLUSTER to the HVAC system control 24. The processor will proceed to step 64 and inquire as to whether the value of "TIMER_CLOCK" equals "MAX_TIME". The value of "MAX_TIME" will be arbitrarily set for the particular office building or office area under examination. In either case, the "TIMER_CLOCK" must exceed the "MAX_TIME" in order for the processor to proceed back to step 42 and again begin to collect the comfort level selections that have been made and stored as "T_INPUT_K" for each office computer in the first office area having an office area index value of one. The menu sections from all such office computers will again be analyzed and an overall comfort level indication for each particular office area will be defined in CLUSTER_N_AVG before proceeding to the next office area. When all such office areas have been analyzed, the overall comfort level indications for each office area will be forwarded to the HVAC control 24 again in step 63.

Figure 5:
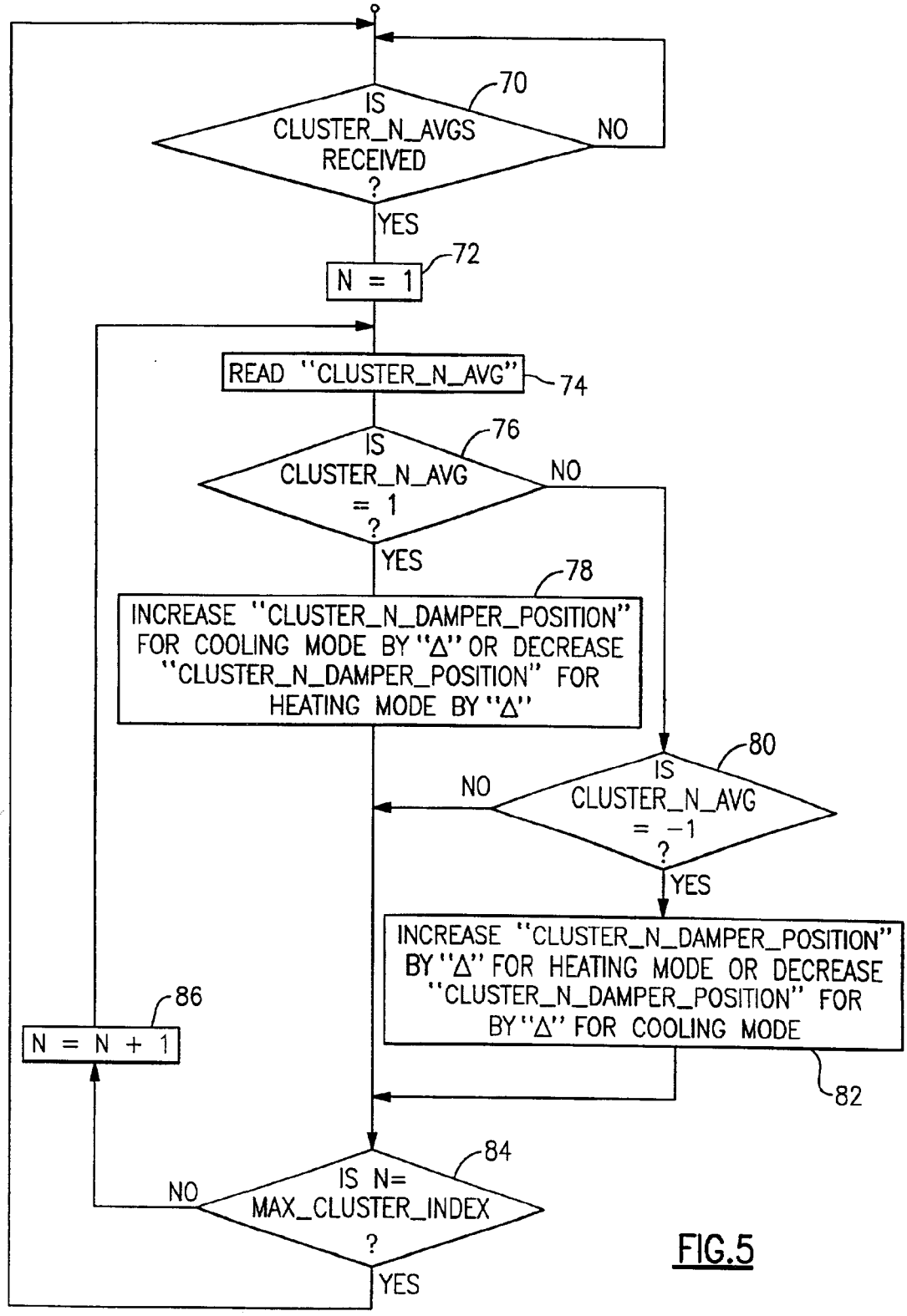
FIG. 5 illustrates an exemplary program that may be executed by a processor within an HVAC system control in response to one or more commands from the network computer executing the program of FIG. 4.

Referring now to FIG. 5, an exemplary program or process is set forth that could be implemented in the HVAC system control 24. The exemplary program could be used in response to the overall comfort level indications for each office area that are sent by the network computer 22. The program or process begins with a processor within the HVAC system control implementing a step 70 wherein inquiries made as to whether all "CLUSTER_N_AVG" values have been received from the network computer 22. When this occurs, the processor proceeds to step 72 and sets the office area index "N" equal to 1. The processor next reads "CLUSTER_N_AVG" for the current index value of "N". The processor proceeds to step 76 and inquires as to whether the read "CLUSTER_N_AVG" of step 74 is equal to one. If it is, the processor will proceed to a step 78.

Referring to step 78, it will be assumed that the HVAC system 10 of FIG. 1 includes damper position controls for each office area within the office building. In such a system employing damper control, the processor will, in step 78, increase a "CLUSTER_N_DAMPER_POSITION" by a predefined amount "Δ" for a cooling mode of operation of the HVAC system. On the other hand, the processor will decrease the same "CLUSTER_N_DAMPER_POSITION" by the incremental amount "Δ" for a heating mode. This will thereby provide more cool air to an office area that has indicated that the office area is too hot or it will decrease the amount of heated air provided in the event that the HVAC system is in a heating mode of operation. Referring again to step 76, in the event that the overall comfort level indication for temperature in the particular office area is not equal to one, then the processor will proceed to step 80 and inquire as to whether "CLUSTER_N_AVG" is equal to −1. In the event that it is, the processor will proceed along a yes path to step 82 and increase the value of "CLUSTER_N_DAMPER_POSITION" by the incremental amount "Δ" when in a heating mode or decrease this damper position variable by "Δ" for a cooling mode. This will have the effect of providing more heated air for an office area that has an overall comfort level indication of being too cold during the heating mode or decreasing the amount of cooled air provided to the same location in the event that the HVAC system is in a cooling mode. The processor will proceed from having either increased or decreased the damper position variable in step 82 to a step 84.

Referring to step 84, it is to be appreciated that this step will be encountered after execution of either step 78, step 82 or step 80. Referring to step 80 the processor proceeds along the no-path out of step 80 when the overall comfort level indication for temperature for the particular office area is neither equal to 1 or −1. The overall comfort level indication for temperature will in this case be 0 indicating that the overall comfort level is just right. The processor will, in step 80, inquire as to whether the value of the office area index "N" equals the value of "MAX_CLUSTER_INDEX". It will be remembered that the value of "MAX_CLUSTER_INDEX" is equal to the highest value of the office area index. This would identify the last office area having an overall comfort level value to be processed. In the event that the processor has not processed the last overall comfort level value for the last office area, the processor will proceed along the no-path and increment the office area index "N" by one in a step 86. The processor will proceed back to step 74 and read the "CLUSTER_N_AVG" for the office area having the newly defined office area index value. The overall comfort level value for temperature for this particular office area will be analyzed and the damper position variables will be appropriately incremented or decremented as has been previously described. At some point the overall comfort level indications for all office area will have been processed again. At this point, the processor will proceed out of step 84 along the yes path back to step 70. The processor will again await receipt of a new set of overall comfort level indications for the office areas before proceeding to analyze each such overall comfort level indication and again, set the damper positions in steps 72 through 86.

Figure 6:
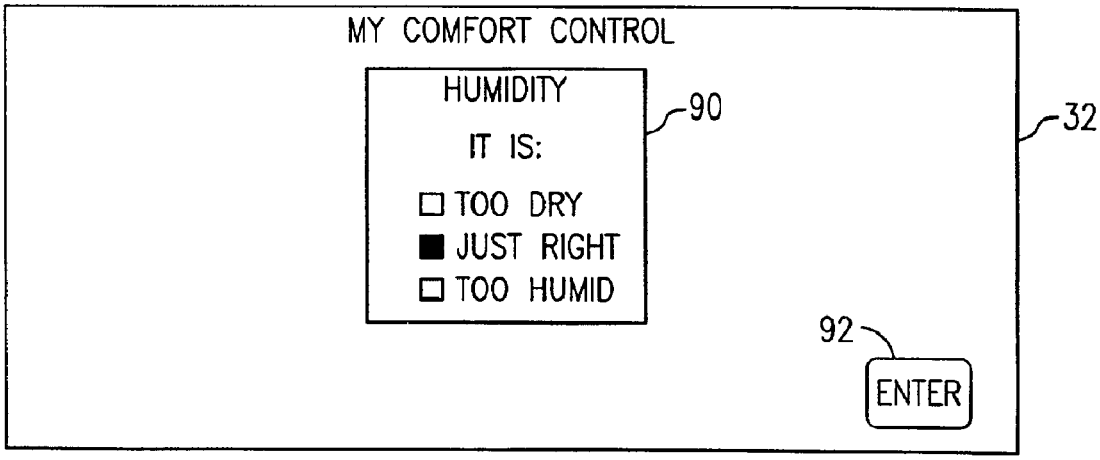
FIG. 6 illustrates the display of an alternative comfort level menu to that of FIG. 2.

Referring now to FIG. 6, an example of an alternative menu that could be displayed on each office computer is shown. The comfort control menu 90 is with respect to humidity. In this regard, the occupant of the room is invited to select between "TOO DRY", "JUST RIGHT" and "TOO HUMID". The occupant clicks on the ENTER icon 92 when the selection has been made. The network computer will analyze the comfort level values for each office computer regarding humidity in much the same manner as been heretofore described with respect to the comfort control for temperature in FIG. 2. The humidity for the particular office area will either be adjusted upwardly or downwardly or no change made to it depending on the overall comfort level indication for the particular office area. This can be done either by dedicated humidifiers in the air flow paths to the particular office areas or it could be done at the central location of the HVAC system. In the latter case, all comfort level indications as to humidity for all office areas would have to be analyzed before determining whether or not to adjust any centrally located humidifier. In this latter instance, if the overall humidity is to be raised, and one or more of the offices, in fact, indicated that they wanted less humidity, then the dampers could be controlled in conjunction with the new raised humidity level for office areas indicating that the comfort level for humidity was already too high.

It is to be appreciated from the above that a number of programs resident in processors within an office computer, a network computer, and an HVAC system control have been disclosed. Alterations, modifications and improvements to these various individual programs may readily occur to those skilled in the art. For instance, the particular comfort control menu may vary as to how it is displayed as well as how many particular comfort level selections may be made. Furthermore, the processor program executed by the network computer could compute the overall comfort level indications for each particular office area in a different manner. The overall comfort level for the office area could moreover be checked for being repetitive if it falls within a range of values of computed overall comfort level indications. It is to be furthermore understood that the particular program implemented by an HVAC system control downstream of the network computer could vary considerably depending on the HVAC system that is to be controlled and the particular overall comfort level indication that is to be responded to. In this regard, an alternative to temperature comfort could be the humidity in each office area. Accordingly, the foregoing description of the particular programs in the preferred embodiment is by way of example only and the invention is to be limited by the following claims and equivalents thereto.

What is claimed is:

1. A process for monitoring the provision of conditioned air to a plurality of locations, said process comprising the steps of:

collecting information as to the levels of comfort entered into at least one data entry device at each location;

computing levels of comfort for each location from the collected information as to the levels of comfort entered at the data entry devices;

determining how many successive times a computed level of comfort has occurred for at least one location; and transmitting a signal when the number of successive times a computed level of comfort for at least one location exceeds a predetermined threshold, whereby the provision of conditioned air to the location can be further examined if necessary.

2. The process of claim 1 wherein said step of determining how many successive times the computed level of comfort for at least one particular location has occurred comprises the steps of:

tracking the number of successive times the computed level of comfort for the location produces the same overall level of comfort; and comparing the tracked number of successive times the computed level of comfort produces the same level of comfort with the predetermined threshold for the particular location.

3. The process of claim 2 further comprising the steps of:

proceeding to said step of transmitting a message when the number of successive times the computed level of comfort exceeds a predetermined threshold; and proceeding to compute the level of comfort of another location when the number of successive times of the computed level of comfort does not exceed the predetermined threshold.

4. The process of claim 1 wherein the predetermined threshold is determined based upon the elapsed time between successive computations of levels of comfort for the particular location.

5. The process of claim 1 further comprising the step of:

transmitting the computed levels of comfort to an HVAC control which controls at least one HVAC system providing conditioned air to the plurality of locations.

6. The process of claim 1 further comprising the steps of:

generating a menu of different comfort levels that may be selected at each data entry device;

storing at least one comfort level that is selected in the data entry device;

transmitting the stored level of comfort to a computer which executes said step of computing levels of comfort for each location from the collected information as to the levels of comfort entered at the data entry devices; and erasing the stored level of comfort from memory in the data entry device whereby the stored level of comfort cannot be transmitted a second time.

7. A system for providing conditioned air to at least one location, said system comprising:

a plurality of data entry devices at the location, each data entry device being operative to provide for the selection of at least one level of comfort at the location;

at least one computer in communication with the plurality of data entry devices, said computer being operative to collect information as to the selections of comfort level entered at the data entry devices and to thereafter compute a level of comfort for the location from the collected information as to the levels of comfort entered at the data entry devices and being furthermore operative to determine how many successive times a particular computed level of comfort for the location has been computed and being furthermore operative to transmit a signal when the number of successive times the particular computed level of comfort exceeds a predetermined threshold, whereby the provision of conditioned air to the location containing the data entry devices can be further examined if necessary; and at least one HVAC control being operative to control the provision of conditioned air to the location in response to the computation of the overall level of comfort for the location.

8. The system of claim 7 wherein each data entry device is operative to generate a menu of different comfort levels that may be selected and entered at each data entry device, each data entry device being thereafter operative to store the entry of a particular comfort level from among the different comfort levels in the menu and being furthermore operative to provide the stored entry of a particular comfort level to the at least one computer in communication with the plurality of data entry devices and being still furthermore operative to thereafter erase the stored entry in the data entry device.

9. The system of claim 7 wherein said at least one computer is operative to track the number of successive times the computed level of comfort for the location the same level of comfort and is furthermore operative to compare the tracked number of successive times the computed level of comfort produces the same level of comfort with the predetermined threshold.

10. The system of claim 9 wherein said at least one computer is operative to proceed to transmit a signal when the number of successive times the computed level exceeds a predetermined threshold and to thereafter proceed to again compute the level of comfort for the location from further information gathered from the data entry devices.

11. The system of claim 7 wherein the predetermined threshold is determined based upon the elapsed time between successive computations of overall levels of comfort from the collected information as to the levels of comfort entered at the data entry devices.

12. The system of claim 9 wherein each data entry device is a personal computer.

13. A system for providing conditioned air to a plurality of locations, said system comprising:

a plurality of data entry devices at each location, each data entry device being operative to provide for the selection of at least one level of comfort;

at least one computer in communication with the plurality of data entry devices, said computer being operative to collect information as to the selections of comfort level entered at the data entry devices and being furthermore operative to compute a level of comfort for each location from the collected information and being furthermore operative to determine how many successive times a particular level of comfort for each location has been computed and being still furthermore operative to transmit a signal when the number of successive times a particular computed level of comfort for a location exceeds a predetermined threshold for that location, whereby the provision of conditioned air to the location can be further examined if necessary; and at least one HVAC control being operative to control the provision of conditioned air to the locations in response to the computation of levels of comfort for the locations.

14. The system of claim 13 wherein each data entry device is operative to generate a menu of different comfort levels that may be selected and entered at each data entry device, each data entry device being thereafter operative to store the entry of a particular comfort level from among the different comfort levels in the menu and being furthermore thereafter operative to provide the stored entry of a particular comfort level to the at least one computer in communication with the plurality of data entry devices and being still furthermore thereafter operative to erase the stored entry in the data entry device.

15. The system of claim 13 wherein said at least one computer is operative to track the number of successive times the computed level of comfort for each location produces the same overall level of comfort for that location and being furthermore operative to compare the tracked number of successive times the computed level of comfort for the location produces the same overall level of comfort with the predetermined threshold.

16. The system of claim 13 wherein said at least one computer is operative to proceed to transmit a message when the number of successive times the previously computed level exceeds a predetermined threshold and to thereafter proceed to compute the level of comfort for another location.

17. The system of claim 13 wherein the predetermined threshold is determined based upon the elapsed time between successive computations of levels of comfort from the collected information as to the levels of comfort entered at the data entry devices.

18. The system of claim 13 wherein each data entry device is a personal computer.

* * * * *